US007894751B2

(12) United States Patent
Kiyono et al.

(10) Patent No.: US 7,894,751 B2
(45) Date of Patent: Feb. 22, 2011

(54) CONTAINER FOR THE STORAGE OF TONER, CONTAINER FOR THE STORAGE OF DEVELOPER AND IMAGE-FORMING APPARATUS USING THESE CONTAINERS

(75) Inventors: Fusako Kiyono, Kanagawa (JP); Yosuke Tsurumi, Kanagawa (JP); Yutaka Saito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/546,356

(22) Filed: Aug. 24, 2009

(65) Prior Publication Data

US 2010/0239323 A1 Sep. 23, 2010

(30) Foreign Application Priority Data

Mar. 19, 2009 (JP) ..... 2009-067605

(51) Int. Cl.
*G03G 15/08* (2006.01)

(52) U.S. Cl. ..... 399/258; 399/262

(58) Field of Classification Search ..... 399/252, 399/258–260, 262, 263; 222/DIG. 1
See application file for complete search history.

(56) References Cited

U.S. PATENT DOCUMENTS 7,676,185 B2 * 3/2010 Tsuji et al. ..... 399/262
2006/0166123 A1 7/2006 Masuda

FOREIGN PATENT DOCUMENTS

| | | |
|---|---|---|
| EP | 1 361 481 A1 | 11/2003 |
| JP | A-2002-214894 | 7/2002 |
| JP | A-2005-099862 | 4/2005 |
| JP | A-2007-206481 | 8/2007 |

OTHER PUBLICATIONS

Extended European Search Report issued in European Patent Application No. 09169479.4.

Nov. 18, 2010 Office Action issued in Australian Patent Application No. 2009212821.

* cited by examiner

*Primary Examiner*—Hoang Ngo
(74) *Attorney, Agent, or Firm*—Oliff & Berridge, PLC

(57) ABSTRACT

A container for storing a toner includes: an electrostatic latent image developing toner that contains: a binder resin containing a polyester resin; a coloring agent; and a release agent, and that has a volume average particle size of about 4 to about 8 μm and an average degree of circularity of about 0.94 to about 0.99; and a toner container main body that stores the electrostatic latent image developing toner, the toner container main body including a material containing at least one of polyethylene terephthalate and polybutylene terephthalate.

22 Claims, 1 Drawing Sheet

FIGURE
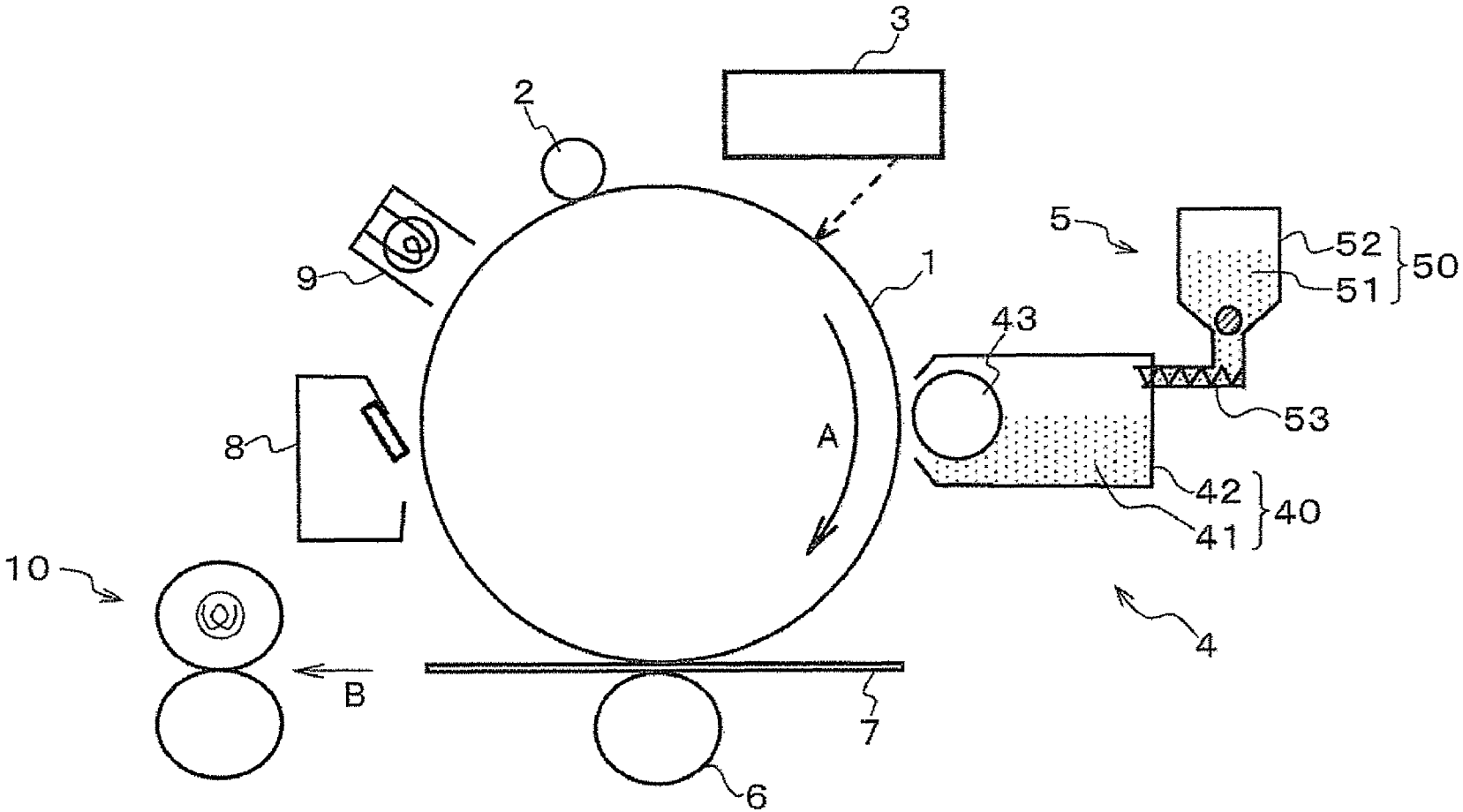

CONTAINER FOR THE STORAGE OF TONER, CONTAINER FOR THE STORAGE OF DEVELOPER AND IMAGE-FORMING APPARATUS USING THESE CONTAINERS

CROSS-REFERENCE TO RELATED APPLICATION

This application is based on and claims priority under 35 USC 119 from Japanese Patent Application No. 2009-067605 filed Mar. 19, 2009.

BACKGROUND

1. Technical Field

The present invention relates to a container for a toner, a container for a developer, and an image-forming apparatus using these containers.

2. Related Art

A method of visualizing image information with a toner via electrostatic latent image formation is now utilized in various fields. In an electrostatic latent image developing method, an image is generally visualized through processes of forming an electrostatic latent image on the surface of a photoreceptor (an electrostatic latent image holder) by charging and exposure, developing the electrostatic latent image as a toner image with a developer for electrostatic latent image development (hereinafter sometimes referred to as merely "a developer") containing an electrostatic latent image developing toner (hereinafter sometimes referred to as merely "a toner"), transfer and fixation.

As developers used here, there are a two-component developer comprising a toner and a carrier for electrostatic latent image development (hereinafter sometimes referred to as merely "a carrier"), and a one-component developer to be used as a toner alone such as a magnetic toner.

In recent years, particle sizes of toners are small sized, particle size distribution is fined, and spheroidization is advanced to respond to the requirement of high image quality. On the other hand, the charging amount of a toner is designed to be heightened in many cases to acquire sufficient gradation reproducibility.

In general, in an image-forming apparatus, a toner is contained in a container for storing a toner, and arbitrarily supplied to a container for storing a developer in a developing unit. The toner charged by stirring in the container for storing the developer is fed to the surface of a photoreceptor (an electrostatic latent image holder), and the electrostatic latent image formed on the surface thereof is developed to form a toner image (a developed image).

SUMMARY

According to an aspect of the invention, there is provided a container for storing a toner, including:

an electrostatic latent image developing toner that contains:

a binder resin containing a polyester resin;

a coloring agent; and a release agent, and that has a volume average particle size of about 4 to about 8 μm and an average degree of circularity of about 0.94 to about 0.99; and a toner container main body that stores the electrostatic latent image developing toner, the toner container main body including a material containing at least one of polyethylene terephthalate and polybutylene terephthalate.

BRIEF DESCRIPTION OF THE DRAWING

Exemplary embodiments of the present invention will be described in detail based on the following figures, wherein:

The drawing is a typical cross-sectional view roughly showing a fundamental structure of a preferred exemplary example of an image-forming apparatus according to an aspect of the invention.

DETAILED DESCRIPTION

A container for storing a toner, a container for storing a developer, and an image-forming apparatus using these containers according to the invention will be described in detail below.

The drawing is a schematic block diagram showing an exemplary embodiment of an image-forming apparatus according to the invention equipped with a container for storing a toner and a container for storing a developer. The invention will be explained with reference to an example applying a two-component system developing unit using a two-component developer comprising a toner and a carrier. Incidentally, as described later, the invention may be applied to a one-component system developing unit comprising a developer of a toner alone.

In the drawing, reference numeral 1 is a photoreceptor (an electrostatic latent image holder) rotation driving in the direction of arrow A, and around 1 are arranged in order of charging unit (a charging unit) 2 of a contact charging system capable of uniformly charging the surface of photoreceptor 1, exposing unit (an electrostatic latent image-forming unit) 3 for forming an electrostatic latent image on the surface of photoreceptor 1 by imagewise irradiating light, developing unit (a developed image-forming unit) 4 to obtain a toner image (a developed image) by developing the electrostatic latent image by supplying two-component developer 41 comprising a toner and a carrier to the surface of photoreceptor 1, transfer unit (a transfer unit) 6 for transferring the toner image (the developed image) formed on the surface of photoreceptor 1 to paper (a recording medium) 7, cleaning unit 8 of a blade system to remove the toner and dust remaining on the surface of photoreceptor 1, and destaticizer 9 to remove the electrostatic latent image on the surface of photoreceptor 1, and further, fixing unit (a fixing unit) 10 is arranged on the downstream in the transfer direction of paper 7 (in the direction of arrow B) to transfer unit 6 to fix the toner image transferred to paper 7.

Charging unit 2 is a charging unit of a contact charging system equipped with a charging roll. Of course in the invention, a charging unit of a non-contact system by conventionally known Corotron and Scorotron may also be used in place of a charging unit of a contact charging system.

As exposing unit 3, optical system units may be used that are capable of imagewise exposing desired light sources, such as a semiconductor laser, LED (light emitting diode), and liquid crystal shutter on the surface of photoreceptor 1. Of these exposing units, it is preferred to use exposing units capable of exposure of incoherent lights.

Developing unit 4, which will be described in detail later, since it has a structure characteristic of the invention. Two-component developer 41 comprising a toner and a carrier is stored in developer container main body 42 to constitute container 40 for storing a developer as a whole, and the toner is charged by friction of the carrier and toner due to stirring by the stirring unit in the inside of the container not shown in the figure. And two-component developer 41 is supplied to the surface of photoreceptor 1 by developing sleeve (a developer holder) 43 and an electrostatic latent image is developed.

Further, developing unit 4 is equipped with toner replenishing unit 5 to replenish the toner in two-component developer 41 in container 40 for storing developer that is consumed by development. Toner replenishing unit 5 consists of container 50 for storing a toner comprising toner container main body 52 for storing toner 51, and supplying unit 53 for conveying toner 51 from container 50 for storing the toner to developing unit 4.

As a transfer unit, a roller type contact transfer charging unit (transfer unit 6) is used in the invention, but a contact transfer type charging unit using a belt, film or rubber blade may also be used, or a Scorotron transfer charging unit and a Corotron transfer charging unit using corona discharge may be used.

As a cleaning unit, cleaning blades consisting of an elastic material like rubber such as cleaning unit 8 are used in the invention, and the method adopted in the invention is a system of removing the toner and the like adhered to the surface of photoreceptor 1 by pressing one edge of the blades against the surface. However, in the invention, brushes using conductive plastics and cleaning unit of other known cleaning systems may be used.

As fixing unit 10, a fixing unit of a two-roll system having an image-fixing member of a pair of roll type is exemplified, but other fixing methods may be adopted in the invention.

In photoreceptor 1 rotation driving in the direction of arrow A, the surface is in the first place uniformly charged by charging unit 2, and then is exposed according to image information by exposing unit 3 to form an electrostatic latent image on the surface of photoreceptor 1 different in potential based on the exposed area/unexposed area. In the next place, the toner charged by one potential is supplied to the surface of photoreceptor 1 by developing unit 4 and the electrostatic latent image is developed to form a toner image, and the toner image is transferred to the surface of paper 7 by means of transfer unit 6. Paper 7 having the unfixed toner image on the surface thereof is conveyed in the direction of arrow B, inserted between the nip of fixing unit 10, and heat and pressure are applied thereto to melt the toner to be fastened to paper 7 to form a permanent image.

On the other hand, the residual toner remained without being transferred and refuse such as paper dust are removed from the surface of photoreceptor 1 by cleaning unit 8 after the toner image has been transferred. Subsequently, the residual electrostatic latent image is removed by destaticizer 9 and a series of image formation cycle is finished to prepare for the next image formation.

In the exemplary embodiment of the invention, container 50 for storing a toner and container 40 for storing a developer have the constitution of the invention. That is, toner 51 stored in toner container main body 52 and the toner in two-component developer 41 stored in developer container main body 42 are toners for electrostatic latent image development comprising a binder resin containing a polyester resin, a coloring agent and a release agent, and having a volume average particle size of 4 to 8 μm or about 4 to about 8 μm and an average degree of circularity of 0.94 to 0.99 or about 0.94 to about 0.99, and toner container main body 52 and developer container main body 42 consist of a material containing at least one of polyethylene terephthalate and polybutylene terephthalate.

Frictional charging is generally caused by difference in charging rows of the members being in contact to each other. In the invention, by using the same kind or the same series of polyester materials in the toner container main body, developer container main body (hereinafter referred to as "the toner container main body and the like"), and the binder resin of the toner, charging rows of both are approaching and frictional charging between both is liable to difficultly occur, so that even with the toners of small particle sizes and a spherical shape whose flowability is liable to lower in the toner container main body and the like, the lowering of flowability in the toner container main body and the like is difficult to occur. Further, since the frictional charging between the inner wall surface of the toner container main body and the like and the toner is restrained, adhesion of toner to the wall of the toner container main body and the like can be prevented.

Stabilization of flowability of the toner in the toner container main body and the like and restraint of adhesion of toner to a wall are related to the stability of supply to the container for storing a developer, which contribute to stabilization of the quality of an image to be formed.

In a toner container not having a stirrer inside, frictional charging between the inner wall surface of the toner container main body and the toner is especially liable to influence the flowability fluctuation. Accordingly, the invention is especially effective in the case of being applied to a toner container.

On the other hand, in the case of a developer container having a stirrer inside and storing two-component developer, although charging by the friction between the toner and the carrier is dominant, charging by the friction between the toner and the inner wall surface of the developer container also has no small influence, and there is a possibility that a part of the developer is adhered to the inner wall surface of the container for storing the developer. Accordingly, the invention is also effectual in the case of being applied to a developer container.

Incidentally, "a toner container main body" in the invention indicates a container itself to store a toner and directly in contact with a toner in a toner replenishing unit to replenish a toner to a developing unit, and does not include mechanisms for replenishment and conveying of the toner and other members. Such a state that the toner is stored in a toner container main body is referred to as "a container for storing a toner" in the invention.

On the other hand, "a developer container main body" in the invention indicates the part such as a container directly being in contact with a developer stored in a developing unit, that is, a developed image-forming unit, and does not include a developer holder, mechanisms for stirring and conveying of the developer and other members. Such a state that the developer is stored in a developer container main body is referred to as "a container for storing a developer" in the invention.

The image-forming apparatus of the exemplary embodiment shown in the drawing has been explained as an example. The container for storing a toner and the container for storing a developer of the invention can be applied to conventionally known image-forming apparatus of electrostatic latent image development systems, and of course they take the constitution of the image-forming apparatus of the invention in any case. For example, the container for storing a toner and the container for storing a developer of the invention is applicable to an image-forming apparatus of a system and a form in which each constitutional member of the image-forming apparatus of the exemplary embodiment is different, an image-forming apparatus of what is called a tandem system having a plurality of image-forming units within with the image-forming unit exemplified in the drawing as one image-forming unit, forming a laminated image by transferring in order an image to an intermediate transfer body, and then transferring the laminated image en bloc to a recording medium, and an image-forming apparatus using what is called a belt nip system fixing unit wherein one or both of two rolls of fixing unit 10 shown in the drawing is (are) made a belt-like member.

Further, in the image-forming apparatus of the exemplary embodiment shown in the drawing, explanations have been done as to image-forming apparatus provided with the constitutions of the invention of both container for storing a toner and container for storing a developer as examples, but image-forming apparatus having either one alone of the constitutions may be corresponded to the image-forming apparatus of the invention, and such an image-forming apparatus exhibits function and effect as the image-forming apparatus of the invention so far as it goes.

Each constitutional element in the invention will be described in detail below item by item.

Toner for Electrostatic Latent Image Development:

A toner for electrostatic latent image development in the invention is stored in a toner container main body as it is, or with a carrier as a two-component developer, or a toner for electrostatic latent image development alone is contained as a one-component developer.

A toner for electrostatic latent image development for use in the invention comprises a binder resin containing a polyester resin, a coloring agent and a release agent, and has a volume average particle size of 4 to 8 μm or about 4 to about 8 μm and an average degree of circularity of 0.94 to 0.99 or about 0.94 to about 0.99. The toner for use in the invention may further contain an external additive and may contain other components for the improvement of flowability and stabilization of a charging property.

Particles comprising the binder resin, coloring agent and release agent other than the external additive are sometimes considered hereinafter by referring to as "toner mother particles" to be distinguished from the toner as a whole including the external additive. Incidentally, the volume average particle size and average degree of circularity that are required of the toner used in the invention are defined as to toner mother particles, but the average degree of circularity of the toner after external additive is added is almost the same as that of the toner mother particles.

Binder Resin:

As the binder resin of the toner for use in the invention, a polyester resin is contained. The polyester resins to be used may be crystalline or amorphous, but it is preferred to use amorphous polyester resins, more specifically polyester resins having an aromatic ring in the constitutional component. Since polyethylene terephthalate and/or polybutylene terephthalate contain(s) an aromatic ring, it is thought that the difference in charging row can be lessened.

For the purpose of exhibiting the effect of the invention, it is preferred that polyester resin predominates in the binder resin. The terminology "predominate" used here means to account for proportion of half or more of all the binder resin components on the basis of mass. As the proportion of the polyester resin to all the binder resin components is more preferably 70 mass % or more, still more preferably 80 mass % or more, still yet more preferably 90 mass % or more, and especially preferably all is polyester resin. As resins other than the polyester resins for use as the binder resin, they are not especially restricted so long as the function as toner is not impaired.

In a case of the later-described core/shell structure toner mother particles, the proportion is discussed by the proportion of the amount of all the polyester resins to all the binder resins of the core part and the shell layer part.

In a case of a polymer obtained by copolymerization of other component to polyester resin main chain, if other component (third component) accounts for 50 mol % or less, this copolymer may be taken as polyester resin in the invention, and proper third component may be copolymerized, if necessary, for the regulation of melting temperature and the like. The copolymerization ratio of the third component is preferably 12.5 mol % or less, and more preferably 2 mol % or less. Other components are not especially restricted so long as they do not conspicuously damage the functions as the toner.

As the polyester resins for use in the invention, conventionally known polyester resins may be used. Commercially available polyester resins may be used in the invention, or polyester resins arbitrarily synthesized may be used.

The polyester resin is synthesized from a polyvalent carboxylic acid component and polyhydric alcohol component.

As the polyhydric alcohol components, for example, as divalent alcohol components, e.g., ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, bisphenol A, hydrogenated bisphenol A, alkylene oxide adduct of bisphenol A, and alkylene oxide adduct of hydrogenated bisphenol A can be used.

As trivalent or higher alcohol components, glycerin, sorbitol, 1,4-sorbitan, trimethylolpropane, etc., can be used.

As the divalent carboxylic acid components to be condensed with the polyhydric alcohol component, for example, maleic acid, maleic acid anhydride, fumaric acid, phthalic acid, terephthalic acid, isophthalic acid, malonic acid, succinic acid, glutaric acid, and lower alkyl esters of these acids can be used.

As the polyvalent carboxylic acid components, aliphatic dicarboxylic acids, e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecane-dicarboxylic acid, and 1,18-octadecanedicarboxylic acid, and aromatic dicarboxylic acids, such as dibasic acids, e.g., phthalic acid, isophthalic acid, terephthalic acid, naphthalene-2,6-dicarboxylic acid, malonic acid, and mesaconic acid are exemplified. Further, anhydrides and lower alkyl esters of these acids are also exemplified.

As trivalent or higher carboxylic acids, 1,2,4-benzene-tricarboxylic acid, 1,2,5-benzenetricarboxylic acid, 1,2,4-naphthalenetricarboxylic acid, and anhydrides and lower alkyl esters of these acids are exemplified.

These acids may be used by one kind alone, or two or more kinds may be used in combination. These are of course exemplifications and the invention is by no means restricted thereto.

As the polyester resins, it is preferred to contain a resin having a mass average molecular weight of 30,000 to 80,000 or about 30,000 to about 80,000 as one of the constitutional components. By containing a resin having a mass average molecular weight of 30,000 to 80,000 as one of the constitutional components, it becomes easy to control the average degree of circularity described in detail later. The preferred range of the mass average molecular weight is from 30,000 to 70,000 or about 30,000 to about 70,000, and more preferably from 30,000 to 60,000 or about 30,000 to about 60,000. When the mass average molecular weight is less than 30,000, the toner is liable to be influenced by a release agent, while when it exceeds 80,000 the viscosity of the resin itself becomes high, so that a preferred average degree of circularity is sometimes difficult to obtain.

Polyester resin particle dispersion for use in the manufacture of toner mother particles by an emulsification aggregation method, which will be described later, can be prepared by dispersing a polyester resin in an aqueous medium, e.g., water, with a surfactant, and polyelectrolyte, e.g., a polymeric acid, a polymeric base, etc., heating the system at a temperature higher than the glass transition temperature of the resin, and treating the system with a homogenizer capable of applying strong shear force, or a pressure-ejecting type disperser. The polyester resin particle dispersion can also be prepared by dissolving a polyester resin in a solvent, dispersion emulsifying the solution in water with an ionic surfactant, and desolvating. The polyester resin particle dispersion can further be prepared according to phase inversion emulsification by dissolving a polyester resin in a solvent, neutralization treatment, adding water to effect phase inversion while stirring, and then desolvating. As the polyester resin, a plurality of kinds of resins may be used as mixture.

The volume average particle size of the polyester resin particles is preferably 1 μm or less, and more preferably the range of 0.02 to 0.5 μm. When the volume average particle size of the polyester resin particles is higher than 1 μm, the particle size distribution and shape distribution of the finally obtained toner broaden, free particles occur and uneven distribution of the composition is caused, which sometimes influence the performances and reliability. While when the volume average particle size of the polyester resin particles is 1 μm or less, the toner is free from these defects, uneven distribution in the toner lessens, good dispersion in the toner can be achieved, scatterings of performances and reliability lower, and so advantageous. The volume average particle size of the polyester resin particles can be measured, for example, with a micro-track (trade name: LS13320, manufactured by Beckmann-Coulter) and the like.

Tg (glass transition temperature) of the toner mother particles for use in the invention is preferably in the range of 50 to 70° C. or about 50 to about 70° C., more preferably in the range of 53 to 65° C. or about 53 to about 65° C., and still more preferably in the range of 55 to 65° C. or about 55 to about 65° C. When Tg of the toner is lower than 50° C., the toner is liable to be deformed and sometimes it is difficult to obtain a toner having a preferred average degree of circularity, and it is also sometimes difficult to obtain a toner having a preferred average degree of circularity when Tg is higher than 70° C.

Coloring agent:

As coloring agents of the toners for use in the invention, conventionally known coloring agents may be used. For example, various kinds of pigments, e.g., carbon black, Chrome Yellow, Hansa Yellow, Benzidine Yellow, Indanthrene Yellow, Quinoline Yellow, Permanent Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Chalcooil Blue, Methylene Blue Chloride, Phthalocyanine Blue, Phthalocyanine Green, Malachite Green Oxalate, etc., and various kinds of dyes, e.g., acridine series, xanthene series, azo series, benzoquinone series, azine series, anthraquinone series, dioxazine series, thiazine series, azomethine series, indigo series, thioindigo series, phthalocyanine series, triphenylmethane series, diphenylmethane series, thiazine series, thiazole series, xanthenes series, etc., are exemplifed, and these coloring agents may be used by one kind alone or two or more in combination.

Coloring agent particle dispersion for use in the manufacture of toner mother particles by an emulsification aggregation method, which will be described later, is preferably prepared by dispersing a coloring agent in water with an ionic surfactant and polyelectrolyte, e.g., a polymeric acid, a polymeric base. For dispersing the coloring agent, known dispersing methods can be used, for example, a rotating shearing type homogenizer, and ordinarily used dispersing unit, such as a ball mill, a sand mill, a Dyno-mill, an altimizer, each of which has media, and the like, can be adopted with no restriction.

The volume average particle size of the coloring agent particles dispersed in the coloring agent particle dispersion is preferably 1 μm or less, and when it is in the range of 80 to 500 nm, a good aggregating property can be obtained and good dispersion of the coloring agent in the toner mother particles can be achieved, and so further preferred.

The content of the coloring agent in the toner mother particles is preferably in the range of 1 to 30 mass parts to 100 mass parts of the binder resin. It is also effective to use, if necessary, surface-treated coloring agents and pigment dispersions. By appropriate selection of the kinds of the coloring agents, a yellow toner, a magenta toner, a cyan toner, a black toner, and the like can be obtained.

Release Agent:

A release agent is generally used in the invention for the purpose of improving the releasing property of the image from the fixing member at fixing time. The specific examples of release agents include low molecular weight polyolefins, e.g., polyethylene, polypropylene, polybutene, etc.; silicones having a softening temperature softened by heating; fatty acid amides, e.g., oleic acid amide, erucic acid amide, ricinoleic acid amide, stearic acid amide, etc.; vegetable waxes, e.g., carnauba wax, rice wax, candelilla wax, Japan wax, jojoba oil, etc.; animal waxes, e.g., bees wax, etc.; mineral and petroleum waxes, e.g., montan wax, ozokerite, ceresine, paraffin wax, microcrystalline wax, Fischer-Tropsch wax, etc.; and ester waxes, e.g., montanic ester, carboxylic ester, etc. These release agents may be used by one kind alone, or two or more kinds may be used in combination in the invention.

The addition amount of the release agents is preferably 1 to 20 mass % or about 1 to about 20 mass % on the basis of all the amount of the toner mother particles, and more preferably 5 to 15 mass % or about 5 to about 15 mass %. When the addition amount of the release agent is in the above range, sufficient effect of the release agent can be achieved, and reduction of the average degree of circularity of the toner by the volume fluctuation of the release agent due to cooling at the time of manufacture of the toner can be controlled.

External Additive:

The toner for use in the invention may be treated by the addition of external additives such as a fluidizing agent and a charging controlling agent. As the external additives, known materials can be used, such as inorganic particles, e.g., silica fine particles surface-treated with a silane coupling agent, etc., titanium oxide fine particles, alumina fine particles, cerium oxide fine particles, carbon black, etc.; organic particles, e.g., polycarbonate, polymethyl methacrylate, silicone resins, etc.; amine metal salts, salicylic acid metal complexes, etc. These external additives may be used alone, or two or more kinds may be used in combination.

In particular, it is preferred to contain particles having a number average particle size of 70 to 300 nm or about 70 to about 300 nm as external additives from the viewpoint of avoiding direct contact of the binder resin of toner and the toner container main body or the developer container main body. The number average particle size is more preferably in the range of 80 to 200 nm or about 80 to about 200 nm.

The materials of the particles of the external additives are not especially limited, and particles may be either inorganic or organic, but in view of prevention of deformation of the external additives, inorganic particles are preferred. Specifically usable materials are the same as those described in the external additives such as fluidizing agents and charging controlling agents.

Other Components:

An internal additive may be added to the toner for use in the invention in the toner mother particles. The internal additive is generally used for the purpose of controlling the viscoelasticity of a fixed image. As the specific examples of internal additives, inorganic fine particles such as silica, titania, etch, and organic fine particles such as polymethyl methacrylate are exemplified, and these particles may be surface-treated for the purpose of heightening the dispersability. They may be used alone or two or more kinds of internal additives may be used in combination.

Other than the above-described components, the toners for use in the invention may further contain, if necessary, internal additives to be added for the purposes besides the above, and various components such as a charging controlling agent.

As the internal additives added for the purposes besides the above, for example, magnetic powders such as metals, e.g., ferrite, magnetite, reduced iron, cobalt nickel, manganese, etc., alloys thereof, and compounds containing these metals are exemplified. By the addition of these magnetic powders, the toners of the invention can be used as magnetic toners.

As the charging controlling agents that can be added to the toners, e.g., quaternary ammonium salt compounds, nigrosine series compounds, dyes comprising complexes such as aluminum, iron, chromium, etc., triphenylmethane series pigments, etc., are exemplified.

Volume Average Particle Size:

The toners for use in the invention have a volume average particle size of 4 to 8 μm. When the volume average particle size is in this range, adhesion preventing effect of the toner to the wall surface of the toner container main body and the like due to charging by the friction between the toner and the wall surface is great.

When the volume average particle size is less than 4 μm, the adhering force of the toner and the wall surface increases by the factors other than electrical factors, in addition to the adhering force of the toner and the wall surface by charging between both, further, the adhering force of the toners to each other increases, which cause reductions of flowability and stability and controlling of the adhesion of the toner to the wall surface is liable to be difficult.

On the other hand, when the volume average particle size is greater than 8 μm, although the influence of charging between the toner and the wall surface on the adhesion of the toner to the wall surface is small, the toner that cannot be controlled and charged is liable to aggregate and grow. Such a toner or an aggregated product thereof is easily developed or transferred and, further, if the toner is transferred to a recording medium, it is large and conspicuous, so that there is a case where influence on fogging is caused.

The volume average particle size prescribed in the invention can be measured, for example, as follows. A measuring sample of 0.5 to 50 mg is added to a surfactant as a dispersant, preferably to 2 ml of a 5 mass % aqueous solution of sodium alkylbenzenesulfonate, which is then added to 100 to 150 ml of ISOTON-II (an electrolyte manufactured by Beckmann-Coulter). The electrolyte in which the measuring sample is suspended is subjected to dispersion treatment with an ultrasonic disperser for about 1 minute, and then particle size distribution of the particles in the range of a particle size of 1.0 to 30 μm is measured with COULTER MULTISIZER-II (manufactured by Beckmann-Coulter) having an aperture of an aperture diameter of 50 μm. The number of particles to be measured is 50,000. The obtained particle size distribution data are plotted relative to the divided particle size ranges (channels) to draw the volume cumulative distribution from the particles having a smaller particle size, and the particle size of cumulative 50% is defined as volume average particle size. Further, the number cumulative distribution is drawn from the particles having a smaller particle size, and the particle size of cumulative 50% is defined as a number average particle size.

The volume average particle size of the toner for use in the invention is preferably 4.5 to 7 μm, and more preferably 5 to 7 μm.

Average Degree of Circularity:

The average degree of circularity of the toner for use in the invention is 0.94 to 0.99. When the average degree of circularity is in this range, contact points of the toner and the wall surface of the container for storing the toner are few, so that it becomes possible to prevent excessive charging.

When the average degree of circularity is less than 0.94, the contact points abound, so that the control of charging is difficult and aggregation of toner to each other is liable to occur.

On the other hand, even when the average degree of circularity exceeds 0.99, there is no large influence on the charging property of the toner but the toner particles turn too spherical, and as to cleaning there is a case where the toner is difficultly cleaned by the operation in an ordinary cleaning process. Further, such an almost spherical toner is extremely difficult to manufacture and not practicable.

The average degree of circularity in the invention is defined according to expression of (equivalent-circle peripheral length)/(peripheral length). Specifically, the average degree of circularity can he obtained by the expression of (peripheral length of a circle having the same projected area as the particle image)/(peripheral length of the projected image of the particle).

The average degree of circularity defined in the invention can be measured, for example, as follows.

The toner of the object of measurement is collected by suction. A very flat flow is formed, a particle image is taken as a still image by instantaneous stroboscopic light emission, and the particle image is measured by means of a flow particle image analyzer (for example, FPIA-2100, manufactured by Sysmex Co.)

The average degree of circularity of the toner for use in the invention is preferably 0.95 to 0.98, and more preferably 0.96 to 0.98.

Manufacturing Method:

The manufacturing method of the toner (toner mother particles) will be described below.

The toner for use in the invention can be manufactured by chemical manufacturing methods such as conventionally known kneading•grinding method, emulsion polymerization method, emulsion aggregation method, suspension polymerization method, etc. From the viewpoints that a toner excellent in storage characteristic/charging property due to surface property and core/shell structure can be manufactured while satisfying the volume average particle size and average degree of circularity required as the toner for use in the invention, and from the aspects of high yield and low environmental load, it is preferred to manufacture the toner by the emulsion polymerization method.

In the emulsion polymerization method, toner mother particles are manufactured through at least two processes. One process is an aggregation process of forming aggregated particles by adding an aggregating agent to a mixed dispersion obtained by mixing a polyester resin particle dispersion having dispersed a polyester resin, a coloring agent dispersion having dispersed a coloring agent, and a release agent dispersion having dispersed a release agent, and heating. Another process is a fusion process of fusing the aggregated particles by heating at a glass transition temperature of the polyester resin or higher. When toner mother particles having a core/shell structure are manufactured, the operation of an adhesion process is carried out between the aggregation process and fusion process.

A method for manufacturing toner mother particles having a preferred core/shell structure according to an emulsification aggregation method will be described in detail below.

Preparation of Mixed Dispersion:

In the first place, various dispersions used in the aggregation process are prepared. As the dispersions to be prepared, a polyester resin particle dispersion, a coloring agent dispersion and a release agent dispersion are at least used, but, if necessary, other dispersions, e.g., a charging controlling agent may be mixed.

These various dispersions are mixed in a prescribed ratio to prepare a mixed dispersion.

When four or five kinds of these dispersions are mixed, all the solids content contained in the obtained mixed dispersion is preferably 40 mass % or less, and more preferably 2 to 20 mass %. The content of the coloring agent particles contained in the mixed dispersion is preferably 20 mass % or less, and more preferably 2 to 15 mass %. The content of the release agent particles contained in the mixed dispersion is preferably 20 mass % or less, and more preferably 5 to 15 mass %.

Each of these dispersions is not especially restricted and an arbitrary method may be used according to the purpose.

Disperser:

Dispersing units are not especially restricted. As usable apparatus, conventionally known apparatus, for example, a HOMOMIXER (manufactured by Tokushu Kika Kogyo Co., Ltd.), a SLASHER (manufactured by Mitsui Mining Co., Ltd.), a CAVITRON (manufactured by Eurotec, Ltc.), a MICROFLUIDIZER (manufactured by Mizuho Kogyo Co., Ltd.), a MANTON GAULIN HOMOGENIZER (manufactured by Manton Gaulin), a NANOMIZER (manufactured by Nanomizer), and a STATIC MIXER (manufactured by Noritake Company, Limited) are exemplified. For the above resins, solvent emulsification and phase inversion emulsification are also exemplified.

Dispersion Medium:

As dispersion media for use in the preparation of various dispersions, aqueous media are exemplified, for example. As preferred aqueous media as dispersion media, water, e.g., distilled water, ion exchange water, etc., and alcohols are exemplified. These media may be used by one kind alone, or two or more kinds may be used in combination.

Surfactant:

In the emulsification aggregation method, it is preferred to previously add a surfactant to various dispersions. As preferred surfactants, anionic surfactants, such as sulfuric ester, sulfonic ester, phosphoric ester, soaps, etc.; cationic surfactants, such as an amine salt type, a quaternary ammonium salt type, etc.; and nonionic surfactants, such as polyethylene glycol, alkylphenyl ethylene oxide adducts, polyhydric alcohols, etc., are exemplified. Of these surfactants, anionic surfactants and cationic surfactants are preferred. It is preferred that the nonionic surfactants are used in combination with the anionic surfactant or cationic surfactant. These surfactants may be used by one kind alone, or two or more kinds may be used in combination.

As the specific examples of the anionic surfactants, aliphatic acid soaps, e.g., potassium laurate, sodium oleate, sodium castor oil, etc.; sulfates, e.g., octyl sulfate, lauryl sulfate, lauryl ether sulfate, nonyl phenyl ether sulfate, etc.; sodium alkylnaphthalene sulfonates, e.g., lauryl sulfonate, dodecyl sulfonate, dodecylbenzene sulfonate, triisopropylnaphthalene sulfonate, dibutylnaphthalene sulfonate, etc.; sulfonates, e.g., naphthalene sulfonate-formalin condensation product, monooctyl sulfosuccinate, dioctyl sulfosuccinate, lauric acid amide sulfonate, oleic acid amide sulfonate, etc.; phosphates, e.g., lauryl phosphate, isopropyl phosphate, nonyl phenyl ether phosphate, etc.; dialkyl sodium sulfosuccinate, e.g., dioctyl sodium sulfosuccinate, etc.; and sulfosuccinate, e.g., lauryl disodium sulfosuccinate, lauryl disodium polyoxyethylene sulfosuccinate, etc., are exemplified.

As the specific examples of the cationic surfactants, amine salts, e.g., laurylamine hydrochloride, stearylamine hydrochloride, oleylamine acetate, stearylamine acetate, stearylaminopropylamine acetate, etc.; and quaternary ammonium salts, e.g., lauryl trimethylammonium chloride, dilauryl dimethylammonium chloride, distearylammonium chloride, distearyl dimethylammonium chloride, lauryl dihydroxyethylmethylammonium chloride, oleyl-bispolyoxy-ethylene methylammonium chloride, lauroylaminopropyl dimethylethylammonium ethosulfate, lauroylaminopropyl dimethylhydroxyethylammonium perchlorate, alkylbenzene dimethylammonium chloride, alkyl trimethylammonium chloride, etc., are exemplified.

As the specific examples of the nonionic surfactants, alkyl ethers, e.g., polyoxyethylene octyl ether, polyoxyethylene lauryl ether, polyoxyethylene stearyl ether, polyoxyethylene oleyl ether, etc.; alkyl phenyl ethers, e.g., polyoxyethylene octyl phenyl ether, polyoxyethylene nonyl phenyl ether, etc.; alkyl esters, e.g., polyoxyethylene laurate, polyoxyethylene stearate, oleate, etc.; alkylamines, e.g., polyoxyethylene lauryl amino ether, polyoxyethylene stearyl amino ether, polyoxyethylene oleyl amino ether, polyoxyethylene soybean amino ether, polyoxyethylene beef tallow amino ether, etc.; alkylamides, e.g., polyoxyethylene lauric acid amide, polyoxyethylene stearic acid amide, polyoxyethylene oleic acid amide, etc.; vegetable oil ethers, e.g., polyoxyethylene castor oil ether, polyoxyethylene rape oil ether, etc.; alkanolamides, e.g., lauric acid diethanol-amide, stearic acid diethanolamide, oleic acid diethanolamide, etc.; and sorbitan ester ethers, e.g., polyoxyethylene sorbitan monolaurate, polyoxyethylene sorbitan monopalmitate, polyoxyethylene sorbitan monostearate, polyoxyethylene sorbitan monooleate, etc., are exemplified.

Other than these, preparation methods of the polyester resin particle dispersion and coloring agent dispersion are as described above in respective items.

Aggregation process:

In the aggregation process, in the first place, an aggregating agent is added to a mixed dispersion obtained by mixing a polyester resin particle dispersion, a coloring agent dispersion, a release agent dispersion, and other components and the mixed dispersion is heated at around a glass transition temperature of the polyester resin to form aggregated particles comprising various components having aggregated therein.

The aggregated particles are formed by the addition of an aggregating agent at room temperature while stirring the mixed dispersion with a rotating shearing type homogenizer.

As the aggregating agents for use in the aggregation process, divalent or higher inorganic metal salts and divalent or higher inorganic metal complexes can be preferably used, in addition to surfactants and reverse polar surfactants used as dispersants in various dispersions. In particular, when inorganic metal salts and inorganic metal complexes are used, the use amount of surfactants can be reduced and charging characteristics of the toner can be bettered, and so preferred.

As the inorganic metal salts, metal salts, e.g., calcium chloride, barium chloride, magnesium chloride, zinc chloride, aluminum chloride, aluminum sulfate, etc., and inorganic metal salt polymers, e.g., aluminum polychloride, aluminum polyhydroxide, calcium polysulfide are exemplified. Of these inorganic metal salts, aluminum salts and polymers thereof are preferred. For obtaining sharper particle size distribution, aggregated particles having narrow particle size distribution are obtained rather by using inorganic metal salts greater in valence, or polymerization type inorganic metal salt polymers are more suitable even if the valence is the same.

The addition amount of these aggregating agents varies depending upon the ion concentration at the time of aggregation, but is generally preferably 0.05 to 1.00 mass % on the basis of the solids content of the mixed dispersion (each material component to become a toner component), and more preferably 0.10 to 0.70 mass %. When the amount is less than 0.05 mass %, the effect of the aggregating agent is difficult to be exhibited, while when it exceeds 1.00 mass %, there is a possibility that excessive aggregation is caused and a toner having a greater particle size easily occurs, and there is a case where an image defect attributable to transfer failure is generated. Further, strong aggregation occurs in the apparatus of toner preparation, so that not preferred on productivity.

Adhesion Process:

In manufacturing toner mother particles of a core/shell structure, covering layers are formed, as an adhesion process, by adhering resin particles including the polyester resin onto the surfaces of aggregated particles formed through the above-described aggregation process (hereinafter, aggregated particles having covering layers on the surfaces of aggregated particles are referred to as "adhesion resin-aggregated particles"). Here, the covering layer corresponds to a shell layer of the toner mother particles formed through a fusion process described later.

The covering layers may be formed by additionally adding an adhesion resin particle dispersion comprising a polyester resin and other resins, if necessary, to the dispersion having formed therein aggregated particles in the aggregation process, and other components such as an aggregating agent (e.g., a pH adjustor, a dispersant, etc.) may also be additionally added simultaneously.

The polyester resins for use in the adhesion resin particle dispersion may be the same with or different from the polyester resins to be used in the core. When different polyester resins are used, those having a glass transition temperature higher(+0 to 20° C.) than that of the polyester resins used in the core are preferred in the light of thermal storage property.

Incidentally, as described above, when the shell layers do not contain a polyester resin, of course, an adhesion resin particle dispersion comprising a constitutional resin other than a polyester resin is prepared and used for the operation in the adhesion process.

After obtaining adhesion resin-aggregated particles by uniformly adhering the adhesion resin particles onto the surfaces of the aggregated particles to form covering layers, when the adhesion resin-aggregated particles are heated and fused in the later-described fusion process, the resin particles comprising binder resin contained in the covering layers on the surfaces of the adhesion resin-aggregated particles are melted to form shell layers. Accordingly, the release agent and coloring agent contained in the core layers positioned inside the shell layers can be effectively prevented from being exposed to the surfaces of the toner mother particles.

By the above constitution, it is possible to make the exposure ratio of the release agent on the surfaces of the toner mother particles to 10% or less or about 10% or less (area ratio) to the entire surfaces of the toner mother particles. The exposure ratio is more preferably 5% or less or about 5% or less, and still more preferably 2.5% or less or about 2.5% or less. It is a matter of course that the greatest lower bound is preferably 0% or about 0%, but the control is difficult and not practicable.

The exposure ratio of the release agent on the surfaces of toner mother particles is specifically measured according to the following method. A toner mother particle is embedded in an epoxy resin, and cut to a slice of 100 nm in thickness with a microtome. The surface of the toner is observed with a scanning electron microscope (SEM) to confirm the release agent from the contrast and shape. That is, there occurs difference between the resin and release agent by dyeing. Further, since the release agent takes the form of being dispersed in the resin, the area ratio is found by image analysis, and the area of the release agent is computed from the entire area. Incidentally, a 0.5% aqueous solution of ruthenium tetroxide is used in dyeing.

The exposure ratio of the release agent is measured in a state that external additives are not added to toner mother particles. In a case of the toner having been added with external additives (hereinafter sometimes referred to as merely "eternally added toner"), a measuring sample is prepared by dispersing 1 g of externally added toner in 100 g of a 0.5% aqueous solution of sodium dodecylbenzene sulfonate, applying ultrasonic wave vibration (output: 60 W, frequency: 20 kHz) to the dispersion for 15 minutes, and then the dispersion is subjected to filtration and drying. The result of measurement in such a manner is fundamentally equivalent to the result of toner mother particles not being externally added. Therefore, in the invention, the exposure ratio of a release agent measured in the above method with an externally added toner is regarded and dealt with as equivalent to a measurement result of toner mother particles not externally added.

The addition mixing method of the adhesion resin particle dispersion in the adhesion process is not especially restricted, and, for example, the dispersion may be added gradually and continuously, or the adhesion process may be divided and performed stepwise in a plurality of times. By the addition and mixture of the adhesion resin particle dispersion like this, generation of minute particles can be restrained and the amount of the release agent on the surface of the toner can be controlled, and the particle size distribution of the obtained toner mother particles can be narrowed as well.

The number of times of the adhesion process in the invention may be one time or may be a plurality of times. By changing the kinds of resins, a plurality of shell layers can also be formed.

The conditions to adhere the adhesion resin particles comprising the binder resin for shell layer to the aggregated particles are as follows.

First, the heating temperature in the adhesion process is preferably from the temperature near the glass transition temperature of the polyester resin for the core contained in the aggregated particles to the temperature near the glass transition temperature of the binder resin for the shell layer. However, the aggregation temperature cannot be determined unconditionally, since the temperature moves up and down with the amounts of aggregating agent and the like. As a rough standard, the range of −25° C. to +10° C. is preferred with the glass transition temperature of the polyester resin for the core as a criterion.

The heating time in the adhesion process cannot be prescribed unconditionally, since it depends upon the heating temperature, but it is generally from 5 minutes to 2 hours or so.

In the adhesion process, the dispersion obtained by supplementary addition of the adhesion resin particle dispersion to the mixed dispersion wherein aggregated particles are formed may be allowed to stand, or may be gently stirred by means of a mixer and the like. The latter case is advantageous in the point that homogeneous adhesion resin-aggregated particles are easily formed.

In the adhesion process, the use amount of the adhesion resin particle dispersion depends upon the particle size of the resin particles contained therein, but it is preferred that the amount is selected so that the thickness of the finally formed shell layers is 20 to 500 nm or so. When the thickness of the shell layers is thinner than 20 nm, there are cases where the release agent is predominantly present on the surface of the toner, while when the shell layer thickness is thicker than 500 nm, there are cases where the average degree of circularity of the toner mother particles greatens, which are not preferred, respectively.

Fusion Process:

In the fusion process, the aggregated particles obtained in the aggregation process or adhesion resin-aggregated particles obtained in the adhesion process are fused by heating. The fusion process may be performed at a temperature higher than the glass transition temperature of the polyester resin and the like contained. As the time required for fusion, short time is sufficient when the heating temperature is high, and long time is required when the heating temperature is low. That is, the time of fusion cannot be unconditionally prescribed, since the time depends upon the heating temperature, but is generally from 10 minutes to 20 hours.

Incidentally, in the fusion process, crosslinking reaction may be carried out at the same time with heating or, alternatively, crosslinking reaction may be performed separately after termination of fusion.

Cooling Process:

The particles obtained after termination of fusion are cooled in the cooling process. There is a case where rapid quenching to a temperature lower than the recrystallization temperature of the release agent and lower than the glass transition temperature of the polyester resin is desired in an emulsification aggregation method for maintaining a smooth surface state. The cooling rate in the cooling process differs with the kind and amount of the crystalline polyester resin of the core layers, but is generally −20° C./min or faster. When the cooling is performed at a rate of faster than −20° C./min, recrystallization of the release agent in the core layers and the growth of domain can be restrained and the exposing amount of the release agent to the surfaces of the toner mother particle can be controlled. Further, getting worse of the average degree of circularity of the toner by the influence of the release agent lowering in volume by cooling can be repressed. When the cooling rate is slower than −20° C./min, recrystallization of the release agent advances, which causes deterioration of the toner shape due to protrusion of the release agent to the surfaces of the toner mother particles. Further, there is a case where such release agent bursts the shell layers to be exposed to the surface and liable to cause unfavorable matters such as adhesion to the inner wall surface of the toner container main body and the like.

Rapid quenching may be carried out, for example, by a method of passing through a heat exchanger utilizing cooling water or brine, and a method of pouring and diluting the toner slurry obtained by operations up to the fusion process into cooling water of two or three times, but the invention is not restricted to these methods.

Washing/Drying Processes:

The fused particles obtained via the fusion process and cooling process are subjected to solid-liquid separation such as filtration, washing, and drying. By virtue of these operations, toner mother particles of a state that external additives are not added are obtained.

In this case, it is preferred for the fused particles to be thoroughly washed to secure sufficient charging characteristics and reliability as toner. In the washing process, conspicuous washing effect can be obtained by treatment with acids such as nitric acid, sulfuric acid and hydrochloric acid, and an alkali solution represented by sodium hydroxide, and washing with ion exchange water and the like.

In the drying process, an arbitrary method can be adopted such as an ordinary vibrating type fluidized drying method, a spray drying method, a freeze drying method, and a flush jet method. In the drying process, it is preferred for the moisture content after drying of the toner mother particles to be adjusted to be 2 mass % or lower, and more preferably 1 mass % or lower.

Electrostatic Latent Image Developer:

In the container for storing a developer of the invention, the electrostatic latent image developer to be stored in the container contains the toner. As described above, the toner is stored as a one-component developer independently as it is, or as a two-component developer with a carrier. When the toner is used as a one-component developer, any charging unit is arranged in the developing unit. While when the toner is used as a two-component developer, the toner is charged by means of the carrier and conveyed.

Carrier:

The carrier is preferably a carrier covered with a resin (a resin-covered carrier, a coated carrier) with ferrite or iron powder as the core material. The core materials (carrier core materials) to be used are not especially restricted, and magnetic metals, e.g., iron, steel, nickel, cobalt, etc., magnetic oxides, e.g., ferrite, magnetite, etc., and glass beads, and the like are exemplified. From the viewpoint of using a magnetic brush method, magnetic carriers are preferred. The average particle size of the carrier core material is preferably about 3 to 10 times the average particle size of the toner.

As the covering resins, acryl resins, styrene resins, amino resins containing urea, urethane, melamine, guanamine, aniline, or the like, amide resins, and urethane resins are exemplified. Copolymer resins of these resins may also be used. As the covering resins of the carrier, two or more resins selected from the above resins may be used in combination.

For the purpose of preventing charging, resin fine particles and inorganic fine particles may be used in the covering resins as dispersion.

As methods of forming a resin covering layer on the surface of a carrier core material, for example, a dipping method of dipping the powder of a carrier core material in a solution for forming a covering layer, a spraying method of spraying a solution for forming a covering layer on the surface of a carrier core material, a fluidized bed method of spraying a solution for forming a covering layer on a carrier core material with the carrier core material floated by fluidized air, a kneader coater method of kneading a carrier core material and a covering layer-forming solution in a kneader coater to remove a solvent, and a powder coating method of atomizing a covering resin, kneading the atomized covering resin and a carrier core material in a kneader coater at a temperature higher than the melting temperature of the covering resin, cooling and covering the covering resin are exemplified, and the kneader coater method and powder coating method are especially preferably used.

The covering amount of the resin formed in the above methods is preferably in the range of 0.5 to 10 mass % to the amount of the carrier core material.

In the two-component developer for use in the invention, the mixing ratio (by mass) of the toner and carrier is in the range of toner/carrier of 1/100 to 30/100, and more preferably 3/100 to 20/100.

Container for Storage:

In the invention, at least one of the toner container main body and the developer container main body consists of a material containing at least one of polyethylene terephthalate and polybutylene terephthalate for securing the flowability with a toner.

For exhibiting the advantage of the invention, it is preferred that at least one of polyethylene terephthalate and polybutylene terephthalate is predominantly contained in a material constituting at least one of the toner container main body and the developer container main body. "Predominantly" used here means to account for the proportion of half or more of the entire constituting materials in terms of mass. The proportion of at least one of the polyethylene terephthalate and polybutylene terephthalate accounting for in the entire constituting materials is more preferably 70 mass % or more or about 70 mass % or more, still more preferably 80 mass % or more or about 80 mass % or more, still yet preferably 90 mass % or more or about 90 mass % or more, and especially preferably all the materials are accounted for by at least one of the polyethylene terephthalate and polybutylene terephthalate. Resins other than polyethylene terephthalate and polybutylene terephthalate for use as the materials constituting at least one of the toner container main body and the developer container main body are not especially restricted so long as they do not conspicuously damage the functions as these containers.

In a case of a polymer obtained by copolymerization of other component to the main chain of polyethylene terephthalate or the main chain of polybutylene terephthalate, if the proportion of other component (the third component) is 50 mol % or less, the copolymer is also regarded as polyethylene terephthalate or polybutylene terephthalate, and a proper third component may be copolymerized for various purposes. The copolymerization ratio of other component is preferably 12.5 mol % or less, and more preferably 2 mol % or less. Other components are not especially restricted so long as they do not conspicuously damage the functions of the toner container main body and the developer container main body.

As the materials for constituting the toner container main body and/or the developer container main body, besides the above materials, mixtures of polyethylene terephthalate and polybutylene terephthalate, and copolymers containing the structural units of these resins are also preferably exemplified.

For manufacturing the toner container main body and the developer container main body moldings from these resins, optional molding methods generally used in molding of resins, such as injection molding, extrusion molding, compression molding, blow molding, calender molding, cast molding, etc., can be used. For example, toner container main bodies and developer container main bodies having desired shapes and dimensions can be obtained at temperatures of 240 to 300° C.

Lubricant:

In the invention, by further addition of a lubricant to the materials constituting the toner container main body and/or the developer container main body, the adhesion of the components of the toner other than the binder resin to the inner walls of these containers can be restrained.

As usable lubricants, fatty acid metal salts, e.g., calcium stearate, barium stearate, sodium oleate, calcium behenate, etc.; fatty acid alkyl esters, e.g., butyl stearate, stearyl stearate, behenyl behenate, behenic acid glycerol ester, etc.; silicones having a softening temperature by heating; fatty acid amides, e.g., oleic acid amide, erucic acid amide, ricinoleic acid amide, stearic acid amide, etc.; vegetable waxes, e.g., carnauba wax, rice wax, candelilla wax, Japan wax, jojoba oil, etc.; animal waxes, e.g., bees wax, etc.; mineral and petroleum waxes, e.g., montan wax, ozokerite, ceresine, paraffin wax, microcrystalline wax, Fischer-Tropsch wax, etc., may be used. Of these lubricants, fatty acid metal salts, fatty acid alkyl esters, and hydrocarbons are preferred from the viewpoint of capable of restraining the release agent in the toner from adhering to the inner wall surface. The addition amount of the lubricants is preferably 0.05 to 10 mass parts or about 0.05 to about 10 mass parts per 100 mass parts of the resin for use in the toner container main body and the like, and more preferably 0.1 to 5 mass parts or about 0.1 to about 5 mass parts.

The container for storing the toner, the container for storing the developer, and the image-forming apparatus using the same have been described, but the invention is by no means restricted thereto. In the image-forming apparatus in the invention, the constitutions other than the container for storing the toner and the container for storing the developer are not especially restricted and conventionally known units can be adopted with no problems.

EXAMPLE

The invention will be specifically described with reference to examples. In the examples "parts" and "%" mean "mass parts" and "mass %" unless otherwise indicated.

-Synthesis Example of Polyester Resin-

Synthesis Example 1

<Synthesis of Resin A>

Ninety-seven point 1 (97.1) parts of dimethyl terephthalate, 58.3 parts of dimethyl isophthalate, 53.3 parts of dodecenyl succinate anhydride, 94.9 parts of bisphenol A-ethylene oxide adduct, 241 parts of bisphenol A-propylene oxide adduct, and 0.12 parts of dibutyl-tin oxide are stirred under nitrogen atmosphere at 180° C. for 6 hours. After that, the reaction solution is stirred at 220° C. for 5 hours while reducing pressure, 8 parts of trimellitic acid anhydride is added, and stirring is performed for further 2 hours to obtain polyester resin (resin A) having a mass average molecular weight Mw of 45,900, a number average molecular weight Mn of 7,900. The glass transition temperature of resin A is 63° C.

-Preparation Example of Resin Particle Dispersion-

<Preparation of Resin Particle Dispersion A>

Three hundred (300) parts of resin A obtained in Synthesis Example 1, 120 parts of ethyl acetate, and 75 parts of isopropyl alcohol are mixed, the resin is dissolved at room temperature (25° C.), 10.4 parts of 10% aqueous ammonia is added thereto, and then 1,200 parts of ion exchange water is gradually dripped to the mixture for phase inversion to obtain an emulsion. In the next place, ethyl acetate and isopropyl alcohol are distilled off under reduced pressure to obtain resin particle dispersion A having dispersed therein resin particles having a number average particle size of 150 nm.

-Preparation Example of Coloring Agent Dispersion-

| <Preparation of coloring agent dispersion 1> | |
|---|---|
| Cyan pigment (C.I. Pigment Blue 15:3 (phthalocyanine pigment, Cyanine Blue 4937, manufactured by Dainichiseika Color & Chemicals Mfg. Co., Ltd.)) | 45 mass parts |
| Anionic surfactant, Neogen SC (manufactured by DAI-ICHI KOGYO SEIYAKU CO., LTD.) | 5 mass parts |
| Ion exchange water | 200 mass parts |

The above components are mixed and dissolved, dispersed with a homogenizer (ULTRA-TURRAX T50, manufactured by IKA) for 10 minutes to obtain coloring agent dispersion 1 having dispersed therein a coloring agent having a number average particle size of 160 nm.

| <Preparation of coloring agent dispersion 2> | |
|---|---|
| Magenta pigment (C.I. Pigment Red 122 (Chromofine Magenta 6887, manufactured by Dainichiseika Color & Chemicals Mfg. Co., Ltd.)) | 45 mass parts |
| Anionic surfactant Neogen SC (manufactured by DAI-ICHI KOGYO SEIYAKU CO., LTD.) | 5 mass parts |
| Ion exchange water | 200 mass parts |

The above components are mixed and dissolved, dispersed with a homogenizer (ULTRA-TURRAX T50, manufactured by IKA) for 10 minutes to obtain coloring agent dispersion 2 having dispersed therein a coloring agent having a number average particle size of 150 nm.

| <Preparation of coloring agent dispersion 3> | |
|---|---|
| Yellow pigment (C.I. Pigment Yellow 74 (Seika fast yellow 2054, manufactured by Dainichiseika Color & Chemicals Mfg. Co., Ltd.)) | 45 mass parts |
| Anionic surfactant Neogen SC (manufactured by DAI-ICHI KOGYO SEIYAKU CO., LTD.) | 5 mass parts |
| Ion exchange water | 200 mass parts |

The above components are mixed and dissolved, dispersed with a homogenizer (ULTRA-TURRAX T50, manufactured by IKA) for 10 minutes to obtain coloring agent dispersion 3 having dispersed therein a coloring agent having a number average particle size of 180 nm.

| <Preparation of coloring agent dispersion 4> | |
|---|---|
| Carbon black (Regal 330, manufactured by Cabot Corporation) | 45 parts |
| Anionic surfactant Neogen SC (manufactured by DAI-ICHI KOGYO SEIYAKU CO., LTD.) | 5 mass parts |
| Ion exchange water | 200 mass parts |

The above components are mixed and dissolved, dispersed with a homogenizer (ULTRA-TURRAX T50, manufactured by IKA) for 10 minutes to obtain coloring agent dispersion 4 having dispersed therein a coloring agent having a number average particle size of 170 nm.

| Preparation of Release Agent Dispersion | |
|---|---|
| Paraffin wax (HNP-9, manufactured by NIPPON SEIRO CO., LTD.) | 100 parts |
| Anionic surfactant (LIPAL 860K, manufactured by Lion Corporation) | 10 parts |
| Ion exchange water | 290 parts |

The above components are mixed and dissolved, dispersed with a homogenizer (ULTRA-TURRAX T50, manufactured by IKA) for 10 minutes, and then subjected to dispersion treatment with a pressure ejection type homogenizer for 30 minutes to obtain release agent dispersion having dispersed therein release agent particles (paraffin wax) having a number average particle size of 200 nm.

-Manufacturer Example of Toner-

<Manufacturer of Toner 1>

After mixing and dispersing the following components with a homogenizer (ULTRA-TURRAX T50, manufactured by IKA) in a round stainless steel flask for 10 minutes, the content of the flask is heated up to 45° C. with stirring and maintained at 45° C. for 30 minutes.

| | |
|---|---|
| Resin particle dispersion A | 455 parts |
| Ion exchange water | 250 parts |
| Coloring agent dispersion 1 | 33.5 parts |
| Release agent dispersion | 67.5 parts |
| A 10% aluminum sulfate aqueous solution | 75 parts |

After that, 210 parts of resin particle dispersion A is additionally added and stirring is continued for further 30 minutes. Growth of aggregated particles having a particle size of 6.3 μm is confirmed in the obtained product by observation with an optical microscope. pH is adjusted with a sodium hydroxide aqueous solution to 7.5, the temperature is raised to 96° C. and the reaction product is allowed to stand for 5 hours, and then cooled. After cooling to 30° C., the reaction product is subjected to filtration, thoroughly washed with ion exchange water, and dried to obtain toner mother particles 1.

The volume average particle size of toner mother particles 1 measured by the above method is 6.5 μm. The average degree of circularity measured similarly is 0.98, and the exposure ratio (area basis) of the release agent is 2.2%.

On the other hand, under nitrogen atmosphere, 160 parts of ethanol, 12 parts of tetra-tert-butylsilane, and 6 parts of distilled water are put in a reaction vessel, stirred at 100 rpm, and 20 parts of 20% hydrochloric acid is dripped over 20 minutes with maintaining that state. After stirring at 23° C. for 5 hours, the reaction product is concentrated with an evaporator until the liquid amount becomes half. Ten (10) parts of tert-alcohol and 300 parts of distilled water are added thereto, and a produced product is precipitated with a centrifugal precipitator. After removing the supernatant by decantation, 300 parts of distilled water is added and separation is carried out with a centrifugal precipitator similarly to the above. After repeating this process three times, the precipitate is freeze dried with a freeze drier for two days to obtain white powder. Ten (10) parts of the white powder is added to a mixed solution comprising 300 parts of toluene and 1 part of hexamethyldisilazane (HMDS), and the mixture is stirred by ultrasonic wave vibration for 30 minutes at room temperature, concentrated, and solidified by drying, followed by drying at 200° C. for 3 hours to obtain silica particles (inorganic oxide particles) A having a number average particle size of 120 nm.

To 1100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.), and 2 parts of silica particles A are added, and mixed with a Henschel mixer at 25 m/s for 5 minutes to obtain toner 1.

<Manufacturer of Toner 2>

Toner 2 is manufactured in the same manner as in the manufacture of toner 1, except that the process of heating and stirring the content of the flask up to 45° C. and maintaining at 45° C. for 30 minutes is changed to a process of heating and stirring up to 47° C. and maintaining at 47° C. for 30 minutes to obtain toner mother particles 2. The volume average particle size of toner mother particles 2 measured by the above method is 6.8 μm, the average degree of circularity measured similarly is 0.98, and the exposure ratio (area basis) of the release agent is 2.2%.

<Manufacturer of Toner 3>

Toner 3 is manufactured in the same manner as in the manufacture of toner 1, except that the process of heating and stirring the content of the flask up to 45° C. and maintaining at 45° C. for 30 minutes is changed to a process of heating and stirring up to 44° C. and maintaining at 44° C. for 20 minutes to obtain toner mother particles 3. The volume average particle size of toner mother particles 3 measured by the above method is 5.2 μm, the average degree of circularity measured similarly is 0.98, and the exposure ratio (area basis) of the release agent is 2.3%.

<Manufacturer of Toner 4>

Toner 4 is manufactured in the same manner as in the manufacture of toner 1, except that the process of heating and stirring the content of the flask up to 45° C. and maintaining at 45° C. for 30 minutes is changed to a process of heating and stirring up to 40° C. and maintaining at 40° C. for 30 minutes to obtain toner mother particles 4. The volume average particle size of toner mother particles 4 measured by the above method is 4.6 μm, the average degree of circularity measured similarly is 0.98, and the exposure ratio (area basis) of the release agent is 2.3%.

<Manufacturer of Toner 5>

Toner 5 is manufactured in the same manner as in the manufacture of toner 1, except that the process of heating and stirring the content of the flask up to 45° C. and maintaining at 45° C. for 30 minutes is changed to a process of heating and stirring up to 50° C. and maintaining at 50° C. for 30 minutes to obtain toner mother particles 5. The volume average particle size of toner mother particles 5 measured by the above method is 7.3 μm, the average degree of circularity measured similarly is 0.97, and the exposure ratio (area basis) of the release agent is 2.1%.

<Manufacturer of Toner 6>

Toner 6 is manufactured in the same manner as in the manufacture of toner 1, except that the process of heating and stirring the content of the flask up to 45° C. and maintaining at 45° C. for 30 minutes is changed to a process of heating and stirring up to 38° C. and maintaining at 38° C. for 30 minutes to obtain toner mother particles 6. The volume average particle size of toner mother particles 6 measured by the above method is 4.2 μm, the average degree of circularity measured similarly is 0.98, and the exposure ratio (area basis) of the release agent is 2.3%.

<Manufacturer of Toner 7>

Toner 7 is manufactured in the same manner as in the manufacture of toner 1, except that the process of heating and stirring the content of the flask up to 45° C. and maintaining at 45° C. for 30 minutes is changed to a process of heating and stirring up to 52° C. and maintaining at 52° C. for 40 minutes to obtain toner mother particles 7. The volume average particle size of toner mother particles 7 measured by the above method is 7.9 μm, the average degree of circularity measured similarly is 0.98, and the exposure ratio (area basis) of the release agent is 2.0%.

<Manufacturer of Toner 8>

Toner 8 is manufactured in the same manner as in the manufacture of toner 1, except that the process of raising the temperature to 96° C. and allowing the reaction product to stand for 5 hours is changed to a process of raising the temperature to 90° C. and allowing the reaction product to stand for 4 hours to obtain toner mother particles 8. The volume average particle size of toner mother particles 8 measured by the above method is 6.6 μm, the average degree of circularity measured similarly is 0.95, and the exposure ratio (area basis) of the release agent is 2.2%.

<Manufacturer of Toner 9>

Toner 9 is manufactured in the same manner as in the manufacture of toner 1, except that the process of raising the temperature to 96° C. and allowing the reaction product to stand for 5 hours is changed to a process of raising the temperature to 86° C. and allowing the reaction product to stand for 4 hours to obtain toner mother particles 9. The volume average particle size of toner mother particles 9 measured by the above method is 6.6 μm, the average degree of circularity measured similarly is 0.94, and the exposure ratio (area basis) of the release agent is 2.2%.

<Manufacturer of Toner 10>

Toner 10 is manufactured in the same manner as in the manufacture of toner 1, except that 455 parts of the first resin particle dispersion A is changed to 500 parts and 210 parts of the additional resin particle dispersion A is changed to 165 parts respectively to obtain toner mother particles 10. The volume average particle size of toner mother particles 10 measured by the above method is 6.4 μm, the average degree of circularity measured similarly is 0.98, and the exposure ratio (area basis) of the release agent is 4.7%.

<Manufacturer of Toner 11>

Toner 11 is manufactured in the same manner as in the manufacture of toner 1, except that 455 parts of the first resin particle dispersion A is changed to 550 parts and 210 parts of the additional resin particle dispersion A is changed to 115 parts respectively to obtain toner mother particles 1. The volume average particle size of toner mother particles 11 measured by the above method is 6.3 μm, the average degree of circularity measured similarly is 0.98, and the exposure ratio (area basis) of the release agent is 9.8%.

<Manufacturer of Toner 12>

Toner 12 is manufactured in the same manner as in the manufacture of toner 1, except that 455 parts of the first resin particle dispersion A is changed to 600 parts and 210 parts of the additional resin particle dispersion A is changed to 65 parts respectively to obtain toner mother particles 12. The volume average particle size of toner mother particles 12 measured by the above method is 6.5 μm, the average degree of circularity measured similarly is 0.98, and the exposure ratio (area basis) of the release agent is 11.1%.

<Manufacturer of Toner 13>

Toner 13 is manufactured in the same manner as in the manufacture of toner 1, except that the process of heating and stirring the content of the flask up to 45° C. and maintaining at 45° C. for 30 minutes is changed to a process of heating and stirring up to 33° C. and maintaining at 33° C. for 50 minutes to obtain toner mother particles 13. The volume average particle size of toner mother particles 13 measured by the above method is 3.8 μm, the average degree of circularity measured similarly is 0.98, and the exposure ratio (area basis) of the release agent is 2.6%.

<Manufacturer of Toner 14>

Toner 14 is manufactured in the same manner as in the manufacture of toner 1, except that the process of heating and stirring the content of the flask up to 45° C. and maintaining at 45° C. for 30 minutes is changed to a process of heating and stirring up to 55° C. and maintaining at 55° C. for 50 minutes to obtain toner mother particles 14. The volume average particle size of toner mother particles 14 measured by the above method is 8.3 μm, the average degree of circularity measured similarly is 0.93, and the exposure ratio (area basis) of the release agent is 2.2%.

<Manufacturer of Toner 15>

Under nitrogen atmosphere, 160 parts of methanol, 12 parts of tetra-tert-butylsilane, and 6 parts of distilled water are put in a reaction vessel, stirred at 250 rpm, and 20 parts of 20% hydrochloric acid is dripped over 20 minutes with maintaining that state. After stirring at 23° C. for 8 hours, the reaction product is concentrated with an evaporator until the liquid amount becomes half. Ten (10) parts of tert-alcohol and 300 parts of distilled water are added thereto, and a produced product is precipitated with a centrifugal precipitator. After removing the supernatant by decantation, 300 parts of distilled water is added and separation is carried out with a centrifugal precipitator similarly to the above. After repeating this process three times, the precipitate is freeze dried with a freeze drier for two days to obtain white powder. Ten (10) parts of the white powder is added to a mixed solution comprising 300 parts of toluene and 1 part of hexamethyldisilazane (HMDS), and the mixture is stirred by ultrasonic wave vibration for 30 minutes at room temperature, concentrated, and solidified by drying, followed by drying at 200° C. for 3 hours to obtain silica particles (inorganic oxide particles) B having a number average particle size of 80 nm.

On the other hand, toner mother particles 1 is obtained in the same manner as in the manufacture of toner 1 up to the preparation of the toner mother particles. To 100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.), and 2 parts of silica particles B are added, and mixed with a Henschel mixer at 25 m/s for 5 minutes to obtain toner 15.

<Manufacturer of Toner 16>

Toner mother particles 1 is obtained in the same manner as in the manufacture of toner 1 up to the preparation of the toner mother particles. To 100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.), and 2 parts of resin particles Epostar S having a number average particle size of 200 nm (a melamine-formaldehyde condensation product, manufactured by Nippon Shokubai Co., Ltd.) are added, and mixed with a Henschel mixer at 25 m/s for 5 minutes to obtain toner 16.

<Manufacturer of Toner 17>

Toner mother particles 1 is obtained in the same manner as in the manufacture of toner 1 up to the preparation of the toner mother particles. To 100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.) is added, and mixed with a Henschel mixer at 25 m/s for 5 minutes to obtain toner 17.

<Manufacturer of Toner 18>

Toner mother particles 1 is obtained in the same manner as in the manufacture of toner 1 up to the preparation of the toner mother particles. To 100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.), and 2 parts of inorganic oxide (silica) particles KE-P30 having a number average particle size of 300 nm (amorphous silica, manufactured by Nippon Shokubai Co., Ltd.) are added, and mixed with a Henschel mixer at 25 m/s for 5 minutes to obtain toner 18.

<Manufacturer of Toner 19>

Toner mother particles 1 is obtained in the same manner as in the manufacture of toner 1 up to the preparation of the toner mother particles. To 100 parts of toner mother particles 1, 1 part of AEROSIL (registered trademark) R972 (hydrophobic fumed silica, surface treated with dimethyldichlorosilane, having a number average particle size of 16 nm, manufactured by Nippon Aerosil Co., Ltd.), and 2 parts of organic particles MP300 having a number average particle size of 120 nm (crosslinked polymethyl methacrylate (PMMA) particles, manufactured by The Soken Chemical & Engineering Co., Ltd.) are added, and mixed with a Henschel mixer at 25 m/s for 5 minutes to obtain toner 19.

-Manufacture Example of Carrier-

To a kneader is put 1,000 parts of Mn—Mg ferrite (a volume average particle size: 35 μm, manufactured by Powder Tech Co., Ltd.), and a solution obtained by dissolving 150 parts of styrene-methyl methacrylate copolymer (polymerization ratio: 30/70, Tg; 110° C., mass average molecular weight: 81,000, manufactured by The Soken Chemical & Engineering Co., Ltd.) in 700 parts of toluene is added thereto. The content in the kneader is mixed at room temperature for 20 minutes, heated at 70° C., dried under reduced pressure, and then taken out to obtain a coated carrier The obtained coated carrier is filtered with a mesh having an aperture diameter of 75 μm to remove coarse powder to obtain a carrier.

-Manufacture Example of Electrophotographic Developer-

The above carrier and toner 1 are put in a V blender in mass ratio of 95/5, and stirred for 20 minutes to obtain one kind of electrophotographic developer 1.

-Manufacture Example of Polyethylene Terephthalate-

A mixed solution is prepared by putting 210 parts of terephthalic acid, 80.8 parts of ethylene glycol, 0.028 parts of germanium dioxide, and 0.024 parts of phosphorous acid to a stainless steel reaction vessel. On the condition of nitrogen atmosphere of 0.20 MPa, the mixed solution is fed over 3 hours so that the temperature in the reaction vessel becomes 240 to 250° C. After feeding, the temperature in the reaction vessel is maintained at 240 to 250° C. for further 4 hours. After that, polymerization reaction is advanced for further 3 hours on the condition of 1.2 KPa and 275 to 280° C. to obtain a reaction product of polyethylene terephthalate. The obtained reaction product is cooled with water and cut with a cutter to obtain pellets. The pellets are dried at 200° C. for 24 hours to obtain polyethylene terephthalate.

-Manufacture Example of Polybutylene Terephthalate-

Polybutylene terephthalate is obtained on the same condition and same operation as in the manufacture of polyethylene terephthalate, except for using 210 parts of terephthalic acid, 117.3 parts of butylene glycol, 0.030 parts of germanium dioxide, and 0.025 parts of phosphorous acid in a stainless steel reaction vessel.

-Manufacture Example of Toner Container Main Body-

| <Manufacture of Toner Container Main Body A> | |
|---|---|
| Polyethylene terephthalate | 100 parts |
| Stearyl stearate (CC-18, manufactured by Nihon Emulsion Co., Ltd.) | 2 parts |

The above components are mixed, melt kneaded with a biaxial extruder (a product manufactured by Toyo Seiki Seisaku-Sho, Ltd.), and molded by putting in a mold for the manufacture of the toner container main body for Apeos Port II C4300 (a product of Fuji Xerox Co., Ltd.) to obtain toner container main body A. Incidentally, parts of the apparatus, such as the lid, are used as they are, and volume variation of the container caused by the difference in the kinds of resins is left as it is unless any matter arises.

<Manufacture of Toner Container Main Body B>

Toner container main body B is manufactured in the same manner as in the manufacture of toner container main body A, except for using 100 parts of polybutylene terephthalate in place of 100 parts of polyethylene terephthalate.

<Manufacture of Toner Container Main Body C>

Toner container main body C is manufactured in the same manner as in the manufacture of toner container main body A, except for using 2 parts of sodium oleate (manufactured by Wako Pure Chemical Industries) in place of 2 parts of stearyl stearate.

<Manufacture of Toner Container Main Body D>

Toner container main body D is manufactured in the same manner as in the manufacture of toner container main body A, except for using 2 parts of polyethylene wax (Mitsui High Wax 200P, manufactured by Mitsui Chemicals, Inc.) in place of 2 parts of stearyl stearate.

<Manufacture of Toner Container Main Body E>

Toner container main body E is manufactured in the same manner as in the manufacture of toner container main body A, except for using 3 parts of polyoxyethylene(4)stearyl ether (BS-4, manufactured by Nikko Chemicals Co., Ltd.) in place of 2 parts of stearyl stearate.

<Manufacture of Toner Container Main Body F>

Toner container main body F is manufactured in the same manner as in the manufacture of toner container main body A, except for not adding stearyl stearate.

<Manufacture of Toner Container Main Body G>

Toner container main body G is manufactured in the same manner as in the manufacture of toner container main body A, except for using ABS resin (Diapet ABS HF-3, manufactured by Mitsubishi Rayon Co., Ltd.) in place of polyethylene terephthalate.

-Manufacture Example of Developer Container Main Body-

<Manufacture of Developer Container Main Body X>

Developer container main body X is manufactured according to the manufacture of toner container main body A by using polyethylene terephthalate used in toner container main body A, except for changing the mold for use in molding to a mold for the manufacture of the developer container main body for Apeos Port II C4300 (a product of Fuji Xerox Co., Ltd.).

<Manufacture of Developer Container Main Body Y>

Developer container main body X is manufactured in the same manner as in the manufacture of developer container main body X, except for using ABS resin (Diapet ABS HF-3, manufactured by Mitsubishi Rayon Co., Ltd.) in place of polyethylene terephthalate used in developer container main body X.

Examples 1 to 22 and Comparative Examples 1 to 3

The combinations of the toners and toner container main bodies as shown in Table 1 below of Examples 1 to 22 and Comparative Examples 1 to 3 are subjected to the evaluation tests described below.

TABLE 1

| Example No. and Comparative Example No. | Toner: Kind of toner | Toner: Volume average Particle size (μm) | Toner: Average Degree of Circularity | Material of the Main Body of Toner Container |
|---|---|---|---|---|
| Example 1 | Toner 1 | 6.5 | 0.98 | A |
| Example 2 | Toner 2 | 6.8 | 0.98 | A |
| Example 3 | Toner 3 | 5.2 | 0.98 | A |
| Example 4 | Toner 4 | 4.6 | 0.98 | A |
| Example 5 | Toner 5 | 7.3 | 0.97 | A |
| Example 6 | Toner 6 | 4.2 | 0.98 | A |
| Example 7 | Toner 7 | 7.9 | 0.98 | A |

TABLE 1-continued

| Example No. and Comparative Example No. | Toner: Kind of toner | Toner: Volume average Particle size (μm) | Toner: Average Degree of Circularity | Material of the Main Body of Toner Container |
|---|---|---|---|---|
| Example 8 | Toner 8 | 6.6 | 0.95 | A |
| Example 9 | Toner 9 | 6.6 | 0.94 | A |
| Example 10 | Toner 10 | 6.4 | 0.98 | A |
| Example 11 | Toner 11 | 6.3 | 0.98 | A |
| Example 12 | Toner 12 | 6.5 | 0.98 | A |
| Example 13 | Toner 15 | 6.5 | 0.98 | A |
| Example 14 | Toner 16 | 6.5 | 0.98 | A |
| Example 15 | Toner 17 | 6.5 | 0.98 | A |
| Example 16 | Toner 18 | 6.5 | 0.98 | A |
| Example 17 | Toner 19 | 6.5 | 0.98 | A |
| Example 18 | Toner 1 | 6.5 | 0.98 | B |
| Example 19 | Toner 1 | 6.5 | 0.98 | C |
| Example 20 | Toner 1 | 6.5 | 0.98 | D |
| Example 21 | Toner 1 | 6.5 | 0.98 | E |
| Example 22 | Toner 1 | 6.5 | 0.98 | F |
| Comparative Example 1 | Toner 13 | 3.8 | 0.98 | A |
| Comparative Example 2 | Toner 14 | 8.3 | 0.93 | A |
| Comparative Example 3 | Toner 1 | 6.5 | 0.98 | G |

-Evaluation Test-

In each toner container main body of Examples and Comparative Examples, 100 g of the toner of each combination is added and allowed to stand for 12 hours on the condition of temperature of 15° C. and humidity of 30%. After that, the feeding and supplying part of toner connecting the container for storing toner and the container for storing developer of the image-forming unit is taken out, and the discharging rate of the toner is adjusted to 0.5 mg/min of the initial discharging rate. The toner is discharged from the container for storing toner and discharging is continued until the toner container is exhausted. After that, the flowability of each toner is evaluated according to the following expression (A).

$$\text{Flowability of toner}=(c-a)\times 100/(b-a)\ (\%) \quad \text{(A)}$$

a: The mass of the vacant toner container (toner container main body)

b: The mass of the toner container containing the toner c: The mass of the toner container after discharging the toner The results obtained are shown in Table 2 below. Those showing the flowability of the toner of 95% or more are taken to be no problem (graded A). The nearer to 100%, the better is the result.

TABLE 2

| Example No. and Comparative Example No. | Flowability of Toner (%) |
|---|---|
| Example 1 | 99 |
| Example 2 | 99 |
| Example 3 | 99 |
| Example 4 | 96 |
| Example 5 | 96 |
| Example 6 | 95 |
| Example 7 | 95 |
| Example 8 | 97 |
| Example 9 | 95 |
| Example 10 | 98 |
| Example 11 | 96 |
| Example 12 | 95 |
| Example 13 | 98 |
| Example 14 | 97 |
| Example 15 | 96 |
| Example 16 | 96 |
| Example 17 | 97 |
| Example 18 | 99 |
| Example 19 | 98 |
| Example 20 | 98 |
| Example 21 | 96 |
| Example 22 | 97 |
| Comparative Example 1 | 89 |
| Comparative Example 2 | 93 |
| Comparative Example 3 | 91 |

Example 23

Container A for storing a toner is obtained by storing 100 g of toner 1 in toner container main body A. Container X for storing a developer is obtained by storing 450 g of electrophotographic developer 1 in developer container main body X. With respect to Apeos Port II C4300 (a product of Fuji Xerox Co., Ltd.), the toner container and developer container in one of four developing units equipped are replaced with toner container A and developer container X, the fixing unit is removed, and the apparatus is modified to be capable of image forming even when operating developing unit is only one.

An image of 10 cm×10 cm square, which is adjusted so that the initial development amount of the toner is 0.4 mg/cm$^2$ when development is performed with modified Apeos Port II C4300, is prepared (40 mg of the toner is to be consumed per one sheet in forming a toner image), and continuous outputting is performed with the modified apparatus.

The development amount is found according to the following expression by removing the toner of the image not fixed that is outputted from the modified apparatus from the paper by blowing off with air, and weighing the masses before and after blowing.

$$Tm\ (\text{mg/cm}^2)=[Ta\ (\text{mg})-Tb\ (\text{mg})]/(10\ \text{cm}\times 10\ \text{cm})$$

In the above expression, Tm represents a development amount of the toner, Ta represents the mass of the paper just after being outputted from the modified apparatus and before removing the toner, and Tb represents the mass of the paper after removing the toner by flowing off with air, respectively.

The development amount of the toner is confirmed every 100 sheets of imaging, and test is finished when the development amount reaches 0.35 mg/cm$^2$. It is confirmed that the outputted number is 2,600 sheets.

Example 24

Continuous outputting test is performed in the same manner as in Example 23, except that developer container Y obtained by replacing developer container main body X with developer container main body Y is used. The outputted number similarly confirmed is 2,300 sheets.

From the above results, it is seen that in developer container Y used in Example 24, lowering of development amount is liable to occur as compared with developer container X used in Example 23. It is presumed as follows. That is, both examples are common in the point that the toner containers of the invention are used in both examples, the flowabilities of the toners are stable up to the developer containers and the toners are stably fed, accordingly certain developing abilities are maintained. However, the toner is liable to be adhered to the inner wall surface of the developer container main body in Example 24, and the adhered toner is substantially not used for development, therefore, presumably development amount cannot be maintained.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A container for storing a toner, comprising:

an electrostatic latent image developing toner that has a volume average particle size of about 4 to about 8 μm and an average degree of circularity of about 0.94 to about 0.99, and that contains:

a binder resin containing a polyester resin;

a coloring agent; and a release agent; and a toner container main body that stores the electrostatic latent, image developing toner, the toner container main body including a material containing at least one of polyethylene terephthalate and polybutylene terephthalate.

2. The container according to claim 1, wherein the electrostatic latent image developing toner further contains an external additive including particles having a number average particle size of about 70 to about 300 nm.

3. The container according to claim 1, wherein the polyester resin contains a resin having a mass average molecular weight of about 30,000 to about 80,000 as one of constitutional components.

4. The container according to claim 1, wherein toner mother particles for the electrostatic latent image developing toner have a Tg (glass transition temperature) of about 50 to about 70° C.

5. The container according to claim 1, wherein an addition amount of the release agent is about 1 to about 20 mass % on the basis of all the amount of toner mother particles for the electrostatic latent image developing toner.

6. The container according to claim 1, wherein an exposure ratio of the release agent on a surface of the electrostatic latent image developing toner is about 10% or less of the entire surface of the toner.

7. The container according to claim 1, wherein the material constituting the toner container main body further contains a lubricant.

8. The container according to claim 7, wherein the lubricant contains at least one component selected from the group consisting of fatty acid metal salt, fatty acid alkyl ester and hydrocarbon.

9. The container according to claim 7, wherein an addition amount of the lubricant is about 0.05 to about 10 mass parts per 100 mass parts of the resin used in the toner container main body.

10. The container according to claim 1, wherein a proportion of the at least one of polyethylene terephthalate and polybutylene terephthalate accounting for the toner container main body is about 70 mass % or more.

11. An image-forming apparatus, comprising:

an electrostatic latent image holder capable of forming an electrostatic latent image on a surface thereof, a charging unit that charges the surface of the electrostatic latent image holder;

an electrostatic latent image-forming unit that forms an electrostatic latent image on the surface of the charged electrostatic latent image holder;

a developed image-forming unit that forms a developed image by supplying an electrostatic latent image developing toner to the electrostatic latent image formed on the surface of the electrostatic latent image holder; and a transfer unit that transfers the developed image to a recording medium, wherein the developed image-forming unit contains the container for storing a toner according to claim 1.

12. A container for storing a developer, comprising:

an electrostatic latent image developing developer containing an electrostatic latent image developing toner that has a volume average particle size of about 4 to about 8 μm and an average degree of circularity of about 0.94 to about 0.99, and that contains:

a binder resin containing a polyester resin;

a coloring agent; and a release agent; and a developer container main body that stores the electrostatic latent image developing developer, the developer container main body including a material containing at least one of polyethylene terephthalate and polybutylene terephthalate.

13. The container according to claim 12, wherein the electrostatic latent image developing toner further contains an external additive including particles having a number average particle size of about 70 to about 300 nm.

14. The container according to claim 12, wherein the polyester resin contains a resin having a mass average molecular weight of about 30,000 to about 80,000 as one of constitutional components.

15. The container according to claim 12, wherein toner mother particles for the electrostatic latent image developing toner have a Tg (glass transition temperature) of about 50 to about 70° C.

16. The container according to claim 12, wherein an addition amount of the release agent is about 1 to about 20 mass % on the basis of all the amount of toner mother particles for the electrostatic latent image developing toner.

17. The container according to claim 12, wherein an exposure ratio of the release agent on a surface of the electrostatic latent image developing toner is about 10% or less of the entire surface of the toner.

18. The container according to claim 12, wherein the material constituting the developer container main body further contains a lubricant.

19. The container according to claim 18, wherein the lubricant contains at least one component selected from the group consisting of fatty acid metal salt, fatty acid alkyl ester and hydrocarbon.

20. The container according to claim 18, wherein an addition amount of the lubricant is about 0.05 to about 10 mass parts per 100 mass parts of the resin used in the developer container main body.

21. The container according to claim 12, wherein a proportion of the at least one of polyethylene terephthalate and polybutylene terephthalate accounting for the developer container main body is about 70 mass % or more.

22. An image-forming apparatus, comprising:

an electrostatic latent image holder capable of forming an electrostatic latent image on a surface thereof;

a charging unit that charges the surface of the electrostatic latent image holder;

an electrostatic latent image-forming unit that forms an electrostatic latent image on the surface of the charged electrostatic latent image holder;

a developed image-forming unit that forms a developed image by supplying an electrostatic latent image developing toner to the electrostatic latent image formed on the surface of the electrostatic latent image holder; and a transfer unit that transfers the developed image to a recording medium, wherein the developed image-forming unit contains the container for storing a developer according to claim 12.

* * * * *